United States Patent [19]

Parker

[11] Patent Number: 4,741,131

[45] Date of Patent: May 3, 1988

[54] ROOF STRUCTURE

[76] Inventor: Geoffrey C. Parker, P.O. Box WK610, Warwick 7, Bermuda

[21] Appl. No.: 934,645

[22] Filed: Nov. 25, 1986

[51] Int. Cl.[4] ..... E04D 3/32; E04D 1/30

[52] U.S. Cl. ..... 52/15; 52/11; 52/57; 52/90; 52/94; 52/309.9; 52/518; 52/560

[58] Field of Search ..... 52/309.9, 406, 555, 52/556, 309.11, 309.4, 560, 518, 11, 15, 57, 94

[56] References Cited

U.S. PATENT DOCUMENTS

| | | | |
|---|---|---|---|
| 358,936 | 3/1887 | Kreuger . | |
| 430,367 | 6/1890 | Babcock . | |
| 462,847 | 11/1891 | Moon . | |
| 490,815 | 1/1893 | Sims . | |
| 2,574,076 | 11/1951 | Westphal | 52/560 |
| 2,831,218 | 4/1958 | Stark | 52/539 |
| 3,133,377 | 5/1964 | Jackson . | |
| 3,339,326 | 9/1967 | Deer | 52/309.11 |
| 3,479,784 | 11/1969 | Massagli | 52/309.11 |
| 3,605,369 | 9/1971 | Merrill | 52/560 |
| 3,760,545 | 9/1973 | Pearse et al. . | |
| 3,875,715 | 4/1975 | Martin | 52/555 |
| 3,932,976 | 4/1976 | Steel | 52/309.9 |
| 4,084,365 | 4/1978 | Read . | |
| 4,096,011 | 6/1978 | Sanders et al. . | |
| 4,104,840 | 8/1978 | Heintz | 52/309.9 |
| 4,213,280 | 7/1980 | Sandborn | 52/309.9 |
| 4,372,090 | 2/1983 | Schichijo . | |
| 4,402,169 | 9/1983 | Martin | 52/540 |

FOREIGN PATENT DOCUMENTS

| | | |
|---|---|---|
| 2497531 | 7/1982 | France . |
| 7409589 | 7/1973 | Netherlands . |

*Primary Examiner*—John E. Murtagh

[57] ABSTRACT

Structure for use on a roof consisting of a plurality of standard elements in the general form of planks that lock together which are formed with a dense outer impermeable skin and a lightweight insulating interior.

14 Claims, 5 Drawing Sheets

ROOF STRUCTURE

BACKGROUND OF THE INVENTION

In certain parts of the world, particularly in the warmer climates, it is common practice to construct buildings with roofs that have an open supporting structure to which are attached slabs of slate or limestone in an overlapping configuration. Commonly, this configuration is covered finally with a layer of cement or mortar. In Bermuda, for instance, the slate is a sandstone slate and is embedded with mortar. Various cementitious coatings are applied to give the roof a white, pleasant appearance. These roofs are commonly provided with water-gathering elements and the water thus collected is directed into a storage tank. Unfortunately, the materials used in such roofs are rapidly becoming scarce. Furthermore, the materials are somewhat irregular in configuration so that it is difficult to standardize the methods of assembly. Furthermore, they are crude in the sense that no interlocking means is provided to assure that the roof is not only waterproof, but also free of other entry, such as dirt, insects and the like. In addition, the traditional materials require expert installation which is expensive and in short supply. These and other difficulties experienced with the prior art devices have been obviated in a novel manner by the present invention.

It is, therefore, an outstanding object of the invention to provide a roof structure which is traditional in appearance, but which is inexpensive to manufacture and install.

Another object of the present invention is the provision of a roof structure which has the "Bermuda" appearance, but which is made of modern materials.

A further object of the present invention is the provision of roof structure of the slab type construction, but which is not subject to deterioration and breakage.

It is another object of the instant invention to provide a roof structure formed of standard uniform elements, providing a water-impervious structure which also serves to insulate against the heat of the sun.

A still further object of the invention is the provision of a slab-type roof structure which is simple in construction, which is inexpensive to manufacture, and which is capable of a long life of useful service with a minimum of maintenance.

It is a further object of the invention to provide a "Bermuda" type roof structure consisting of inexpensive materials which can be installed by unskilled labor.

With these and other objects in view, as will be apparent to those skilled in the art, the invention resides in the combination of parts set forth in the specification and covered by the claims appended hereto.

SUMMARY OF THE INVENTION

In general, the present invention relates to a roof structure for use on a building having rafters sloping downwardly from a ridge and having purlins connecting the upper surfaces of the rafters. A series of elongated plank elements are provided extending across the rafters and parallel to the purlins, each plank element having a main body of generally rectangular cross-section formed with a water impermeable skin enclosing a light-weight reinforced interior mass. Each plank has a tail member extending from one edge and constituting an extension of one flat surface. The main body of each upper adjacent plank rests on the tail member of its next lower adjacent plank.

More specifically, the main body has a broad flat upper surface and a spaced parallel broad flat lower surface, the surfaces being joined at their adjacent edges by curved transition surfaces. The end of each tail member is provided with a curved locking lip that engages and interlocks with a transition surface of the next adjacent plank.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 4:
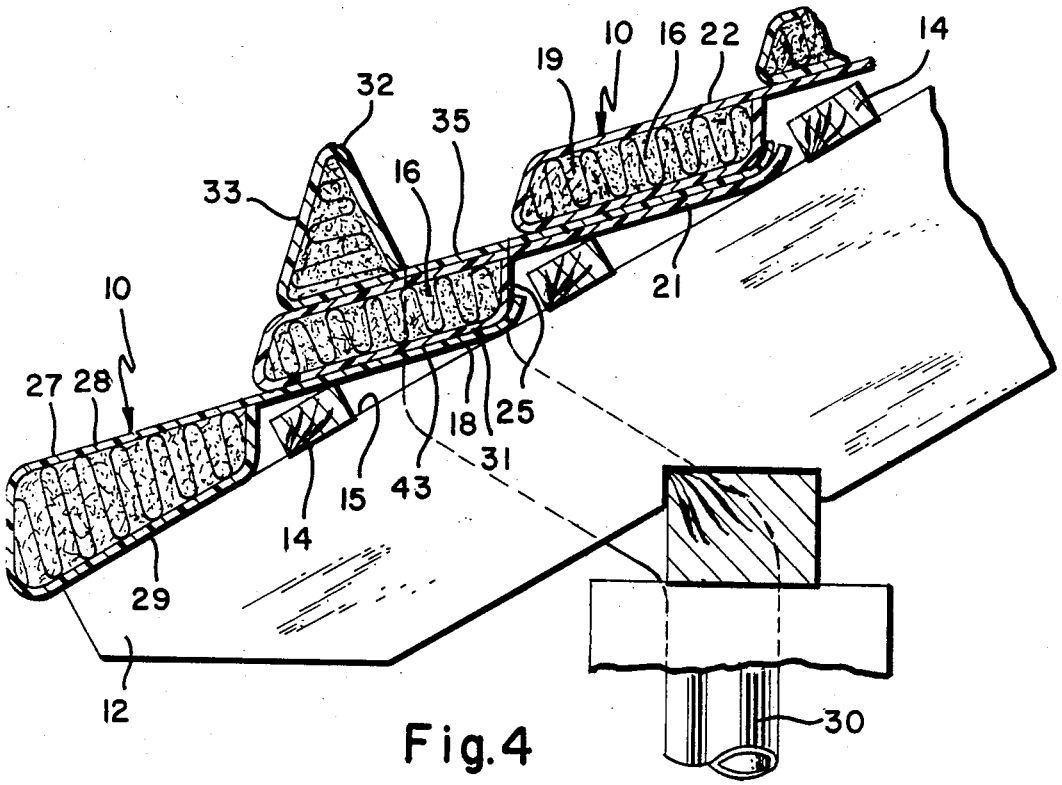
FIG. 4 is a vertical sectional view of the roof structure at the eave end thereof.

Referring to FIGS. 1 through 4, which show the details of the roof structure, indicated generally by the reference numeral 10, the construction of the roof adjacent to the ridge is shown. FIG. 4 shows the structure adjacent the eave. The roof structure 10 is shown in use on a building 11 having spaced rafters 12 which slope downwardly from a ridge 13. Extending horizontally across the top edges of the rafters are horizontal purlins 14 which connect the upper surfaces 15 of the rafters and lock them together.

A plurality of plank elements 16 extend across the rafters 12 parallel to the purlins 14. Each plank element has a main body 17 (as best evident in FIG. 2) which is of generally a rectangular cross-section and is formed with a water-impermeable skin 18 that encloses a light-weight interior mass 19 which can be reinforced. Each plank 16 has a tail member 21 whose outermost edge is provided with a curved lip 20. The main body 17 of each upper adjacent plank element 16 rests on the tail member 21 of its next lower adjacent plank 16.

The main body 17 has a broad, flat, upper surface 22 and a broad, flat, lower surface 23 which is parallel to and spaced from the upper surface. The two surfaces are joined at their adjacent edges by curved transition surfaces 24 and 25. The lip 20 of the lower plank element engages and fits the shape of the transition surface 25 of the main body of the plank element which rests on its tail member 21.

The plank elements 16 which are located adjacent to the ridge 13 of the building are bridged by a ridge element 26 of tent-like configuration.

Figure 1:
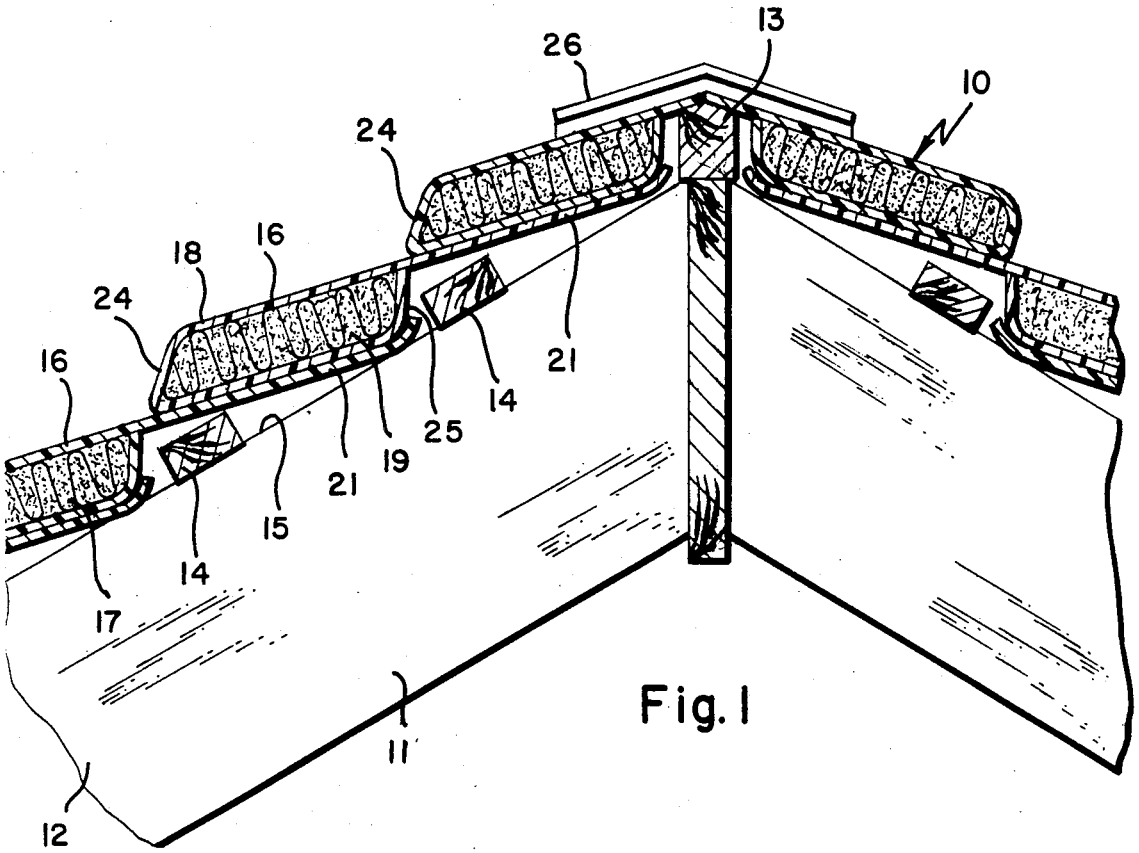
FIG. 1 is a vertical sectional view showing a roof structure embodying the principles of the present invention.
Figure 2:
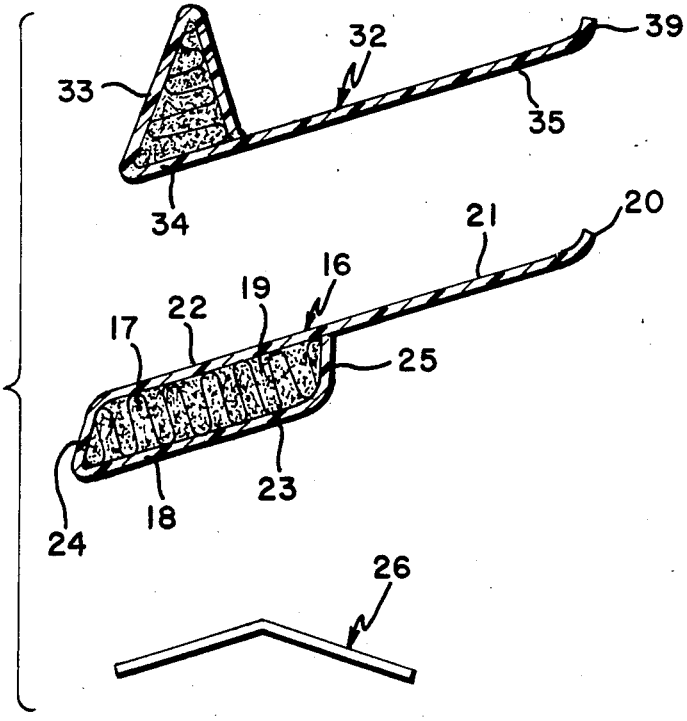
FIG. 2 shows cross-sectional views of certain standard elements used in the roof structure.

As is evident in FIG. 2, the tail member 21 constitutes an extension of the upper surface 22 of the main body and overlies a purlin 14 that is adjacent the upper transition surface 25 of the main body 17 of the plank element.

This is best evident in FIG. 4, an eave element 27 overlies the lower ends of the rafters 12 and is similar in construction to a plank element 16, except that the upper and lower surfaces 28 and 29 of the eave element 27 lie at an angle to one another, so that they are further apart at the lower edge than they are at the upper edge from which a tail member 31 extends.

As is also evident in FIG. 4, a rainwater guide element 32 overlies one of the plank elements 16. The rainwater guide element has a main body 33 of triangular cross-section whose base 34 lies on the upper surface 22 of the plank element. The rainwater guide element has a tail member 35 that extends from the base and overlies the tail member 21 of the plank element 16. The guide element 32 has a curved lip 39 formed on its tail member in a manner similar to that of the plank elements.

Figure 5:
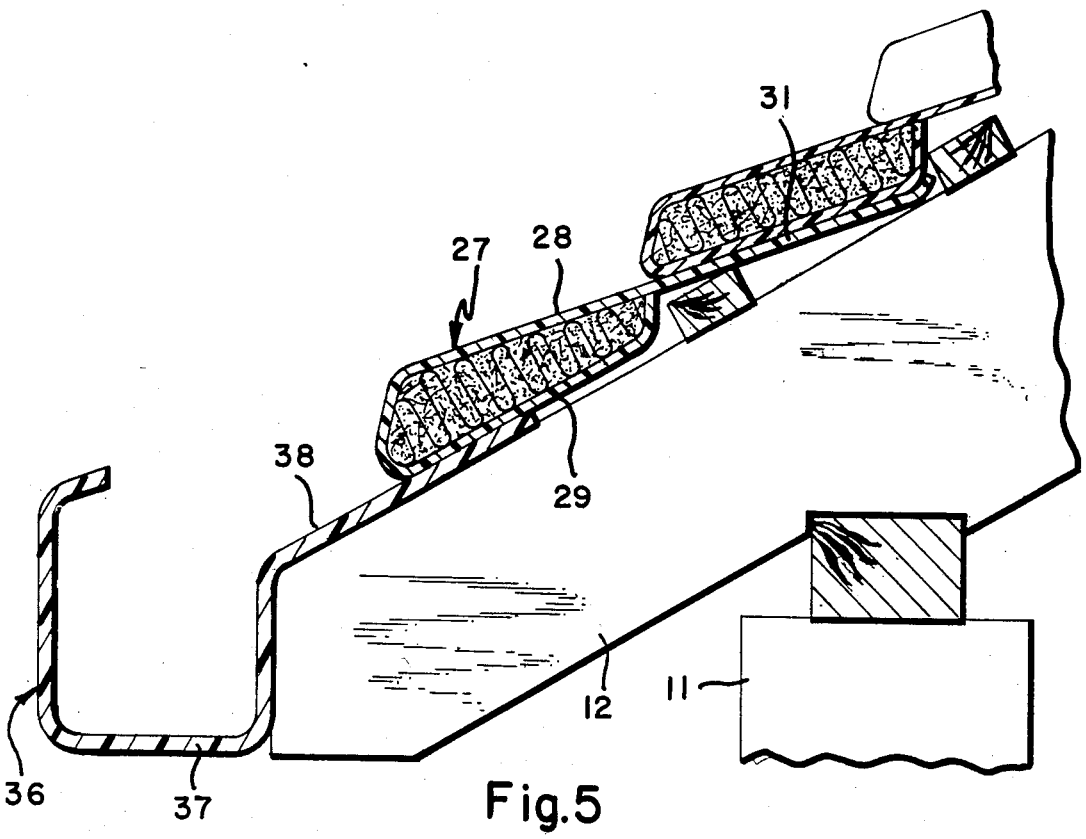
FIG. 5 shows a modified form of the roof structure.

In FIG. 5, it can be seen that a modified form of the invention makes use of a gutter element 36 which is provided with a trough 37 from which extends a tail member 38. Tail member extends under and is held in place by the main body of an eave element 27.

Figure 6:
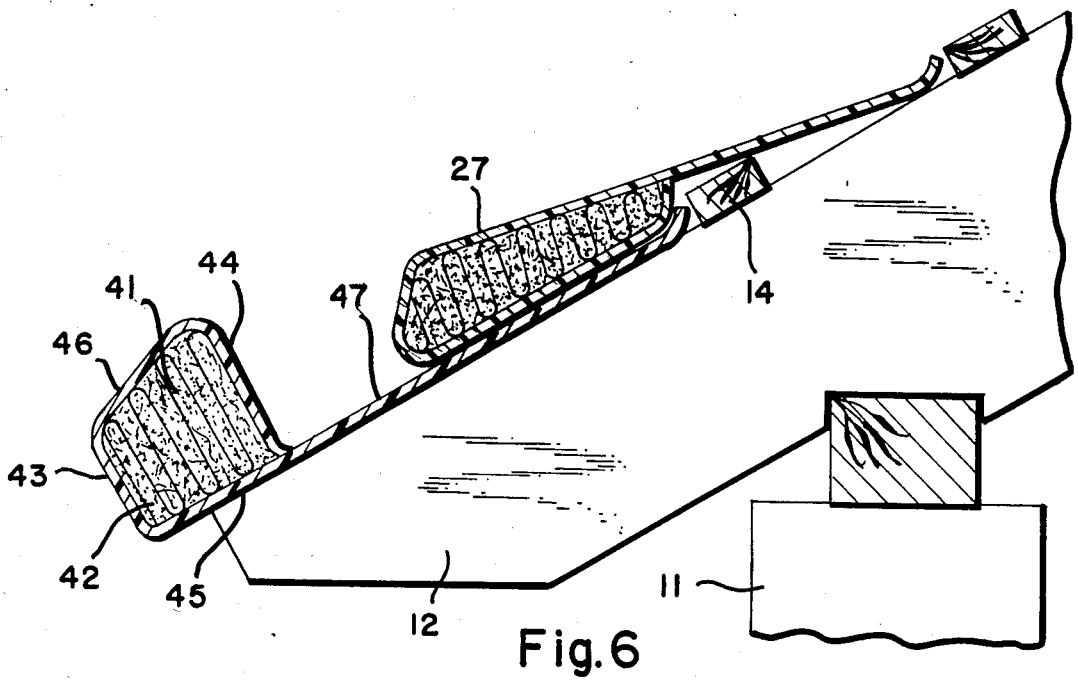
FIG. 6 is a vertical sectional view of a still further modified form of the roof structure.

In FIG. 6, a gutter element 41 overlies the lower ends of the rafters 12 and is similar in construction to a plank element 16 except that the main body 42 has a cross-section of tetragonal shape and has two spaced parallel surfaces 43 and 44 extending at right angles to the bottom surface 45. A surface 46, which is opposed to the bottom surface 45, lies at a substantial angle to it. The gutter element has a tail member 47 on which rests the main body of an eave element 27.

Figure 7:
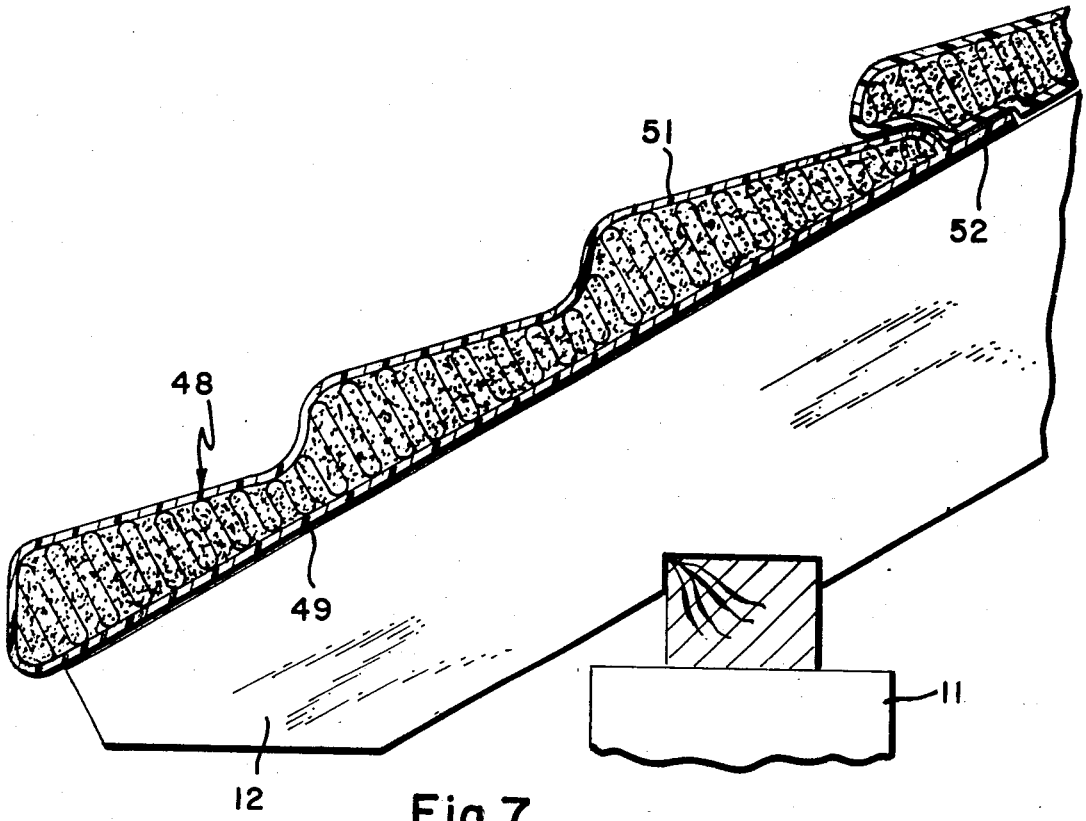
FIG. 7 is a vertical sectional view of another form of the roof structure.

In FIG. 7, a roof structure is shown in which an eave element 48 has a flat undersurface 49 which is adapted to lie along the upper edges of the rafters 12. The upper surface 51 of the eave element consists of a series of flat surfaces of plank width lying at an angle to the undersurface, which flat surfaces are joined by curved transition surfaces to resemble a plurality of plank elements. A tail member 52 extends from the main body in the plane of the undersurface.

Figure 8:
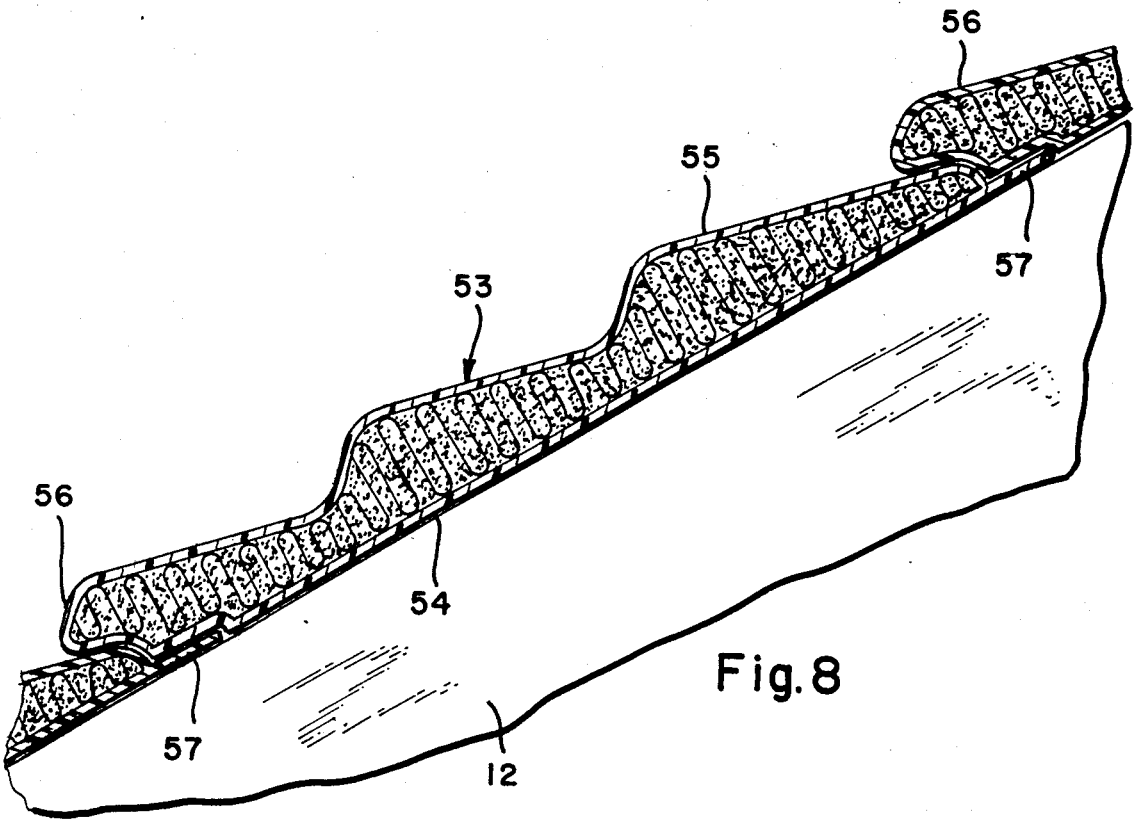
FIG. 8 is a vertical sectional view of a still further modification of the invention.

Referring to FIG. 8, it can be seen that a roof structure is shown in which a plank 53 has a flat undersurface 54 which is adapted to lie along the upper edges of the rafters 12. The upper surface 55 consists of a series of flat surfaces of plank width lying at an angle to the undersurface 54 and joined by curved transition surfaces to resemble a plurality of plank elements 16. The lower edge is recessed to form a nose 56 that overlies the upper edge of the next lower eave or plank element and to receive the tail member of that next lower element. A tail member 57 extends from the main body of the plank element 53 in the plane of the undersurface 54.

Figure 10:
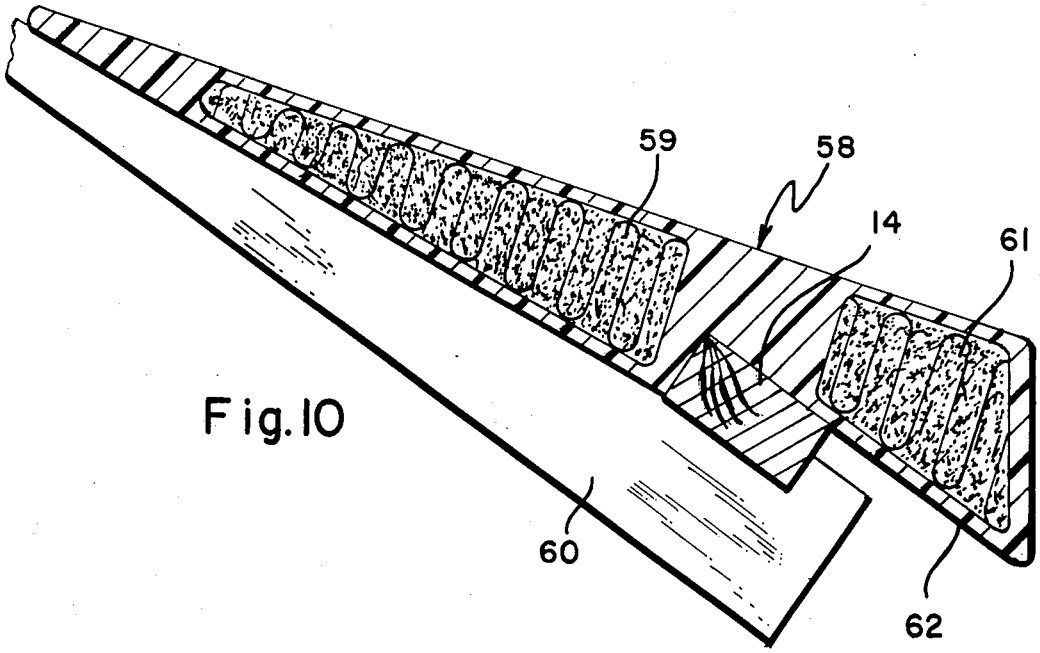
FIG. 10 is a vertical sectional view of a still further modification of the invention.

FIG. 10 shows a roof structure which makes use of an eave element 58 which overlies the lower ends of false rafters 59 and locks into a purlin 14. The element 58 is similar in construction to a plank element except that the upper and bottom surfaces of the main body 59 intersect and lie at an angle to one another. The lower edge of the main body is provided with an extension 61 having an upper surface that is an extension of the upper surface of the main body and a lower surface 62 that is spaced upwardly from but parallel to the bottom surface of the main body to extend outwardly of the ends of the rafters.

Figure 9:
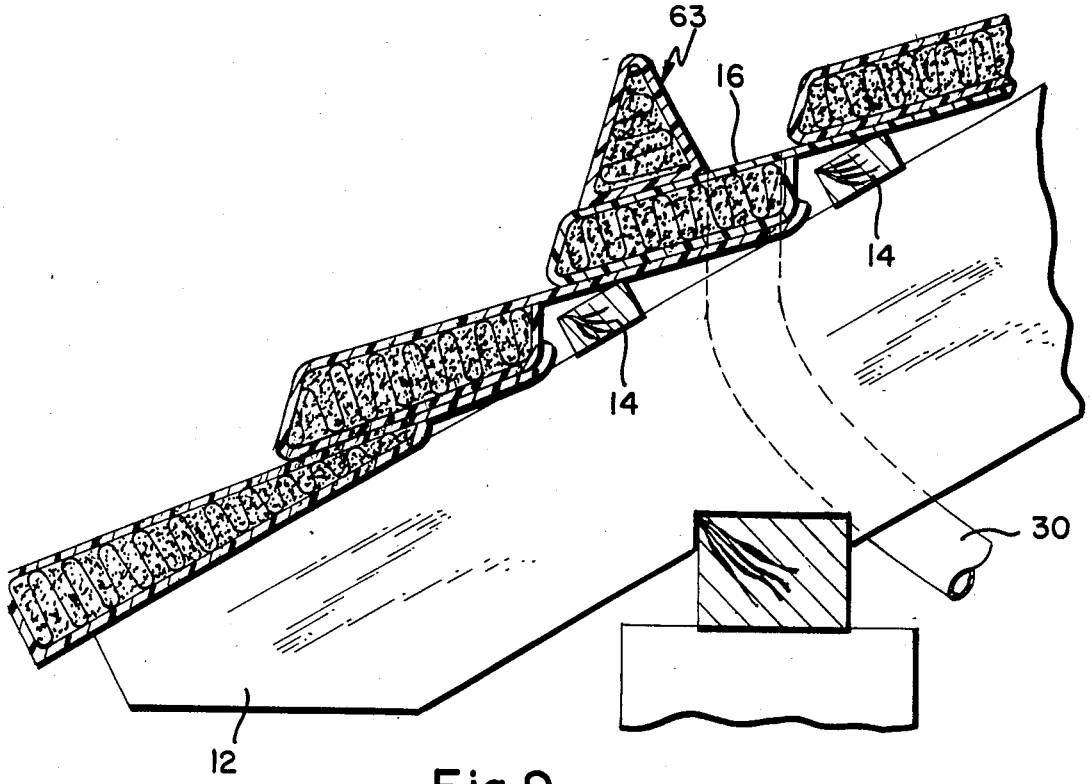
FIG. 9 is a vertical sectional view of a further modification of the roof structure.

FIG. 9 shows a modified form of the roof structure in which a rainwater guide element 63 overlies the main body of one of the plank elements 16. The element 63 has a main body of triangular cross section whose base lies on the upper surface of the main body of the said plank element and is cemented firmly in place.

As is evident in FIGS. 4 and 12, a water collection downpipe 30 extends downwardly from a portion of the roof above the rainwater guide elements 32 and 63 (respectively) to carry water into storage tanks in the usual way.

Figure 3:
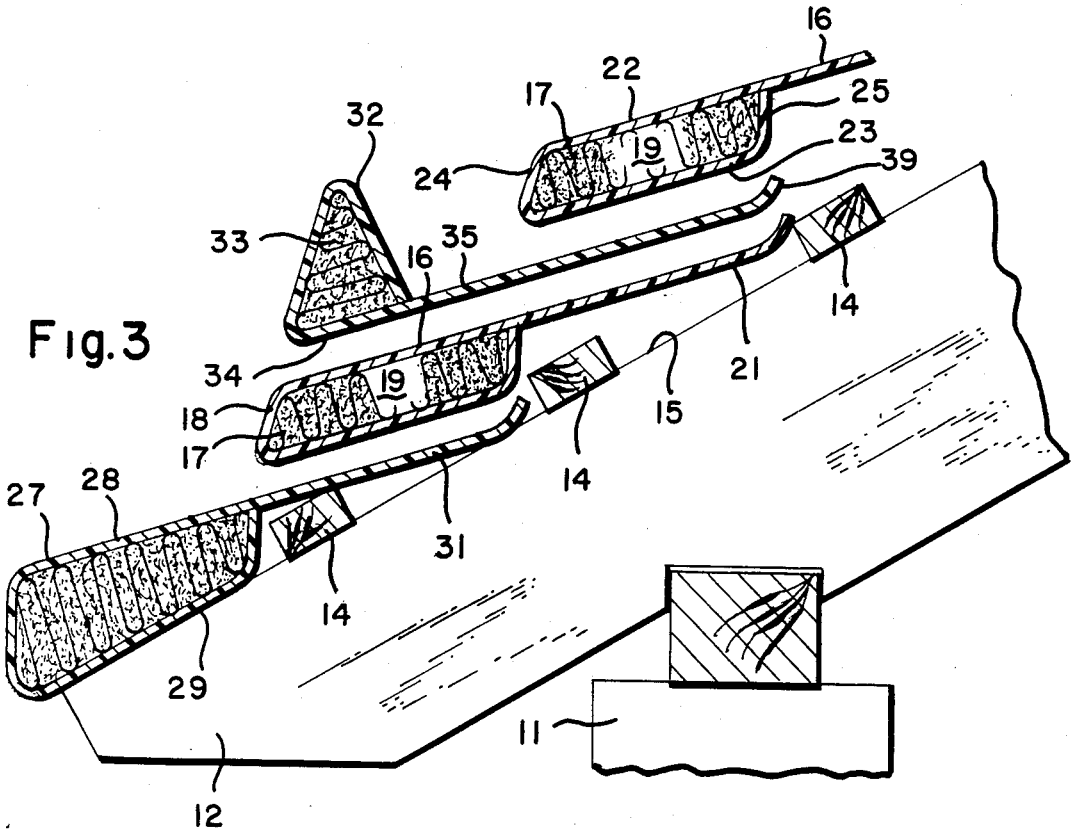
FIG. 3 shows the manner in which the elements are assembled to form a roof structure.

The manner in which the roof elements are assembled is best shown in FIG. 3 in which it can be seen that the eave element 28 is first applied to the top of the rafters 12 with its main body lying on one side of a purlin 14 and the tail member 31 extending over the purlin. A plank element 16 is then applied resting on top of the tail member 31 with its upper curved transition surface resting neatly against the lip on the tail member 31. The plank members tail member 21 extends over the adjacent purlin 14 and engages the upper edge of the rafters. The rainwater guide 32 is then attached to the top of the next plank element 16 and with the tail member 35 nesting in the tail member 21 of the plank element. Finally, another plank element 16 is applied to the top of the tail member 35 of the rainwater guide element with its tail member bridges over the next purlin 14. It is evident from the above description that all of the elements of the roof structure, including the plank element 16, the rainwater guide element 32, and the eave element 27 (as well as the various modified forms of these elements) are formed in a manner similar to the plank elements; that is to say, they are formed with a dense impermeable skin 24 which encloses in the main body a light-weight insulating interior mass which can be reinforced. In the preferred embodiment, the skin 24 and its extension in the tail member 21 of the plank element 16 is formed of a dense plastic, glass-reinforced cement, fibreglass, aluminum, etc. The interior mass is formed of an insulated filler, such as phenolic foam, polyurethane, etc. that may be reinforced. The elements that are formed with this dense outer skin and the light-weight insulating interior can be manufactured by one of several methods, including that used in producing the well-known "structural foam." In this method, the plastic is injected into a mold while gas bubbles are being formed in the mass of plastic. Engagement of the mass of plastic with the cold surface of the mold causes the bubbles to break in the exterior of the mass to form a dense skin. Fiberglass lying in the mass of plastic thus injected serves to reinforce the structure. The structure can also be formed by other methods, such as by forming the dense outer skin first and then filling the hollow interior with glass-reinforced foam plastic. The structure can also be formed by laying of the dense outer skin over a pre-sized, shaped block of insulation, such as produced with glass-reinforced cement, fibreglass, or dense plastic. Such materials as are well known in the art may be used, so long as they provide the impermeable, dense, outer skin and the insulating, reinforced interior. Reinforcement, of course, can also take place by use of rods or metal screen.

It can be seen from the above description that the roof structure that incorporates the principles of the present invention not only provides for waterproofing, but, because of the interlocking of the lips on the tail members with the curved transition surfaces of the main bodies, provides a watertight joining of the elements, particularly if suitable cements are used to fasten them together. The insulating material in the main bodies, of course, acts as a heat insulation which is particularly important in warmer climates to keep heat out and in colder climates to keep the heat in. Because of the interlocking, there are no gaps between the elements and, therefore, wind and rain can not enter. At the same time, the elements can be manufactured in a controlled factory environment, so that they are exactly identical elements and fit together in a precision manner, thus lending itself to construction of the roof by unskilled labor. The production in a controlled factory and the installation by inexpensive labor means results in a roof construction that is not only of higher quality than the prior slate construction, but is less expensive. The roof also has the appearance of the traditional "Bermuda slate roof".

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Roof structure for use on a building having rafters sloping downwardly from a ridge and having purlins connecting the upper surfaces of the rafters, comprising:

(a) a series of elongated plank elements extending across the rafters and parallel to the purlins, each plank element having a main body of generally rectangular cross-section formed with a water-impermeable skin enclosing a light-weight reinforced interior mass, each plank having a tail member extending from one edge and constituting an extension of one flat surface, the main body of each upper adjacent plank resting on the extension member of its next lower adjacent plank, (b) a ridge element of tent-like configuration bridging the plank elements adjacent the ridge, (c) an eave element overlying the lower ends of the rafters and is similar in construction to a plank element, except that the upper and lower surfaces lie at an angle to one another so that they are further apart at the lower edge than they are at the upper edge from which a tail member extends, (d) a rainwater guide element overlying one of the plank elements, the rainwater guide element having a main body of triangular cross-section whose base lies on the upper surface of the plank element and having a tail member that extends from the base and overlies the tail member of the plank element, and (e) a gutter element consisting of a trough member from which extends a tail member, the tail member extending under and held in place by the main body of the eave element.

2. Roof structure as recited in claim 1, wherein the main body has a broad flat upper surface and a spaced, parallel broad flat lower surface, the surfaces being joined at their adjacent edges by curved transition surfaces.

3. Roof structure as recited in claim 1, wherein the tail member constitutes an extension of the said upper surface and overlies a purlin located adjacent the upper transition surface of the main body.

4. Roof structure for use on a building having rafters sloping downwardly from a ridge and having purlins connecting the upper surfaces of the rafters, comprising:

a series of elongated plank elements extending across the rafters and parallel to the purlins, each plank element having a main body of generally rectangular cross-section formed with a water-impermeable skin enclosing a light-weight interior mass, each plank having a tail member extending from one edge and constituting an extension of one flat surface, the main body of each upper adjacent plank element resting on the tail member of its next lower adjacent plank, wherein the main body has a broad flat upper surface and a spaced, parallel broad flat lower surface, the surfaces being joined at their adjacent edges by curved transition surfaces, and wherein the ends of the tail member is provided with a curved locking lip.

5. Roof structure as recited in claim 4, wherein the plank elements adjacent the ridge are bridged by a ridge element of tent-like configuration.

6. Roof structure as recited in claim 4, wherein the tail member constitutes an extension of the said upper surface and overlies a purlin located adjacent the upper transition surface of the main body.

7. Roof structure for use on a building having rafters sloping downwardly from a ridge and having purlins connecting the upper surfaces of the rafters, comprising:

a series of elongated plank elements extending across the rafters and parallel to the purlins, each plank element having a main body of generally rectangular cross-section formed with a water-impermeable skin enclosing a light-weight interior mass, each plank having a tail member extending from one edge and constituting an extension of one flat surface, the main body of each upper adjacent plank element resting on the tail member of its next lower adjacent plank, wherein an eave element overlies the lower ends of the rafters and is similar in construction to a plank element, except that the upper and lower surfaces lie at an angle to one another so that they are further apart at the lower edge than they are at the upper edge from which a tail member extends.

8. Roof structure as recited in claim 7, wherein a gutter element is provided consisting of a trough from which extends a tail member, the tail member extending under and held in place by the main baody of the eave element.

9. Roof structure as recited in claim 7, wherein the main body of the eave element has a flat under surface adapted to lie along the upper edges of the rafters, wherein the upper surface consists of a series of flat surfaces of plank width lying at an angle to the under surface and joined by curved transition surfaces to resemble a plurality of plank elements, and wherein a tail member extends from the main body in the plane of the under surface.

10. Roof structure for use on a building having rafters sloping downwardly from a ridge and having purlins connecting the upper surfaces of the rafters, comprising:

a series of elongated plank elements extending across the rafters and parallel to the purlins, each plank element having a main body of generally rectangular cross-section formed with a water-impermeable skin enclosing a light-weight interior mass, each plank having a tail member extending from one edge and constituting an extension of one flat surface, the main body of each upper adjacent plank element resting on the tail member of its next lower adjacent plank, wherein a rainwater guide element overlies one of the plank elements, the rainwater guide element having a main body of triangular cross-section whose base lies on the upper surface of the plank element and having a tail member that extends from the base and overlies the tail member of the plank element.

11. Roof structure for use on a building having rafters sloping downwardly from a ridge and having purlins connecting the upper surfaces of the rafters, comprising:

a series of elongated plank elements extending across the rafters and parallel to the purlins, each plank element having a main body of generally rectangular cross-section formed with a water-impermeable skin enclosing a light-weight interior mass, each plank having a tail member extending from one edge and constituting an extension of one flat surface, the main body of each upper adjacent plank element resting on the tail member of its next lower adjacent plank, wherein the main body of the plank element has a flat upper surface adapted to lie along the upper edges of the rafters, wherein the upper surface consists of a series of flat surfaces of plank width lying at an angle to the under surface and joined by curved transition surfaces to resemble a plurality of plank elements, wherein a tail member extends from the main body in the plane of the under surface, and wherein the lower edge is recessed to form a nose to overlie the upper edge of the next lower eave or plank element and to receive the tail member of that next lower element.

12. Roof structure for use on a building having rafters sloping downwardly from a ridge and having purlins connecting the upper surfaces of the rafters, comprising:

a series of elongated plank elements extending across the rafters and parallel to the purlins, each plank element having a main body of generally rectangular cross-section formed with a water-impermeable skin enclosing a light-weight interior mass, each plank having a tail member extending from one edge and constituting an extension of one flat surface, the main body of each upper adjacent plank element resting on the tail member of its next lower adjacent plank, wherein a gutter element overlies the lower ends of the rafters and is similar in construction to a plank element, except that the main body has a cross-sectional tetragonal shape with two spaced, parallel surfaces extending at right angles to the bottom surface, the surface opposed to the bottom surface lying at a substantial angle to it.

13. Roof structure for use on a building having rafters sloping downwardly from a ridge and having purlins connecting the upper surfaces of the rafters, comprising:

a series of elongated plank elements extending across the rafters and parallel to the purlins, each plank element having a main body of generally rectangular cross-section formed with a water-impermeable skin enclosing a light-weight interior mass, each plank having a tail member extending from one edge and constituting an extension of one flat surface, the main body of each upper adjacent plank element resting on the tail member of its next lower adjacent plank, wherein an eave element overlies the lower ends of the rafters and is similar in construction to a plank element, except that the upper and bottom surfaces of the main body intersect and lie at an angle to one another, and wherein the lower edge is provided with an extension having an upper surface that is an extension of the upper surface of the main body an a lower surface that is spaced upwardly from but parallel to the bottom surface of the main body to extend outwardly of the ends of the rafters.

14. Roof structure for use on a building having rafters sloping downwardly from a ridge and having purlins connecting the upper surfaces of the rafters, comprising:

a series of elongated plank elements extending across the rafters and parallel to the purlins, each plank element having a main body of generally rectangular cross-section formed with a water-impermeable skin enclosing a light-weight interior mass, each plank having a tail member extending from one edge and constituting an extension of one flat surface, the main body of each upper adjacent plank element resting on the tail member of its next lower adjacent plank, wherein a rainwater guide element overlies the main body of one of the plank elements, the rainwater guide element having a main body of triangular cross-section whose base lies on the upper surface of the main body of the said plank element.

* * * * *